US006634617B2

(12) United States Patent
Potvin

(10) Patent No.: US 6,634,617 B2
(45) Date of Patent: Oct. 21, 2003

(54) FORM LINER

(75) Inventor: Jeffrey M. Potvin, Hillsborough County, FL (US)

(73) Assignee: Inco Chemical Supply Company, Inc., Odessa, FL (US)

( * ) Notice: Subject to any disclaimer, the term of this patent is extended or adjusted under 35 U.S.C. 154(b) by 0 days.

(21) Appl. No.: 09/835,133

(22) Filed: Apr. 5, 2001

(65) Prior Publication Data

US 2001/0020669 A1 Sep. 13, 2001

Related U.S. Application Data

(63) Continuation-in-part of application No. 09/236,529, filed on Jan. 25, 1999, now abandoned.

(51) Int. Cl.[7] ..... B28B 7/36

(52) U.S. Cl. ..... 249/16; 249/47; 249/112; 249/189

(58) Field of Search ..... 249/16, 33, 44, 249/47, 112, 189, 192

(56) References Cited

U.S. PATENT DOCUMENTS 5,632,922 A * 5/1997 Nasvik et al. ..... 249/112

5,885,502 A * 3/1999 DeAngelis et al. ..... 249/112

* cited by examiner

*Primary Examiner*—James P. Mackey
(74) *Attorney, Agent, or Firm*—Arthur W. Fisher, III

(57) ABSTRACT

A form liner for use in a system to produce a surface of cementitious material including a plurality of surface areas each produced by a form liner to simulate the appearance of natural stone or rock and grout lines formed without seams visible between adjacent surface areas wherein each form liner comprises a mold including an obverse relief surface having a raised edge formed about the outer portion of the periphery thereof with at least one pair of opposite sides and a random inner circuitous raised edge formed inwardly thereof with a plurality of irregular contoured pockets formed therein to cooperatively form the simulated grout line and simulated stones or rocks respectively wherein the opposite pair of opposite sides of the outer raised edge is interrupted or discontinuous to form at least one plug recess such that when adjacent form liners are operatively aligned relative to each other corresponding plug recesses cooperated form a cavity to selectively receive a keystone liner plug having an irregular contoured pocket formed therein to form a simulated stone or rock to disguise the line formed between adjacent surface areas as grout lines.

2 Claims, 9 Drawing Sheets

FORM LINER

CROSS-REFERENCE

This is a continuation-in-part application of Ser. No. 09/236,529 filed Jan. 25, 1999, now abandoned.

BACKGROUND OF THE INVENTION

1. Field of the Invention

A form liner for use in producing a wall, roadway, sidewalk or floor of cementitious material having the appearance of natural stone and mortar.

2. Description of the Prior Art

The high cost of labor and material have made the use of genuine brick, stone, rock and tile in construction prohibitively expensive.

As a result, relatively inexpensive polymers and concrete have become popular in the manufacture of artificial brick, stone, rock and tile. Artificial brick surfaces are relatively easy to produce. However the production of aesthetically appealing artificial stone is more difficult Specifically, replicating the texture resembling real stone and the color is often poor.

U.S. Pat. No. 5,885,502 shows a form liner having recesses configured to receive a plug along the periphery thereof.

U.S. Pat. No. 5,632,922 discloses a form liner having irregular shaped recesses.

U.S. Pat. No. 5,372,676 describes a method of producing replicated paving stone including a base having a shaded and straified layered upper surface with a plurality of simulated gourt lines formed therein. The method includes the steps of preparing a cementitious mortar, applying a release agent to the interior of a forming mold, pouring the cementitious mortar into the forming mold, leveling the mortar, vibrating the forming mold and cementitious mortar therein, allowing the cementitious mortar to cure forming a base with an upper surface, releasing the base from the forming mold, applying an acid stain to the base, allowing the acid stain to etch the base to shade the upper surface, accenting the plurality of simulated grout lines with a pigment and sealing the replicated paving stone with an acrylic polymer sealer.

U.S. Pat. No. 5,637,236 shows a method for producing a wall, roadway, sidewalk or floor of cementitious material having the appearance of natural stone and mortar including a base with an outer surface with a plurality of irregular shaped protrusions disposed in a random pattern to simulate natural stones and a plurality of simulated grout lines formed therebetween. The method includes the steps of preparing a cementitious material, pouring the cementitious material into a form, vibrating the cementitious material, allowing the cementitious material to cure forming the base with the outer surface, releasing the base with the plurality of irregular shaped protrusions disposed in the random pattern to simulate natural stones and the plurality of simulated grout lines formed therebetween from the form, coloring the outer surface and accenting the plurality of simulated grout lines.

U.S. Pat. No. 4,027,846 shows a panel for casting concrete comprising a frint casting plate having a flat front surface constituting a support surface for cast concrete and a rear plate spaced from the front plate. A lwyer of expanded plastic foam material such as polyurethane foam of high density is cast, in situ, between the plates and effects joinder of plates with the foam layer to form an assembled panel which behaves as a beam and has high resistance to bending and shear stresses.

U.S. Pat. No. 5,098,059 teaches an assembly comprising a foam piece of high density styrofoam for use in concrete casting having a front surface, a back surface and edges. The assembly further comprises a flexible, non-permeable plastic film surrounding the foam piece. In one aspect of the invention, the plastic film surrounding the foam piece is heat shrunk. In another aspect of the invention, the foam piece defines a block out for use in concrete casting.

U.S. Pat. No. 4,887,789 shows a form for molding building components such as columns from building materials such as concrete. The form is sculpted from a plastic material such as polystyrene, urethane or styrofoam.

U.S. Pat. No. 4,310,370 shows a process for producing decorative articles comprising the steps of placing into mutual contact and laminating a hardenable decorative layer and an expansion-contraction deformable sheet provided with regions susceptible to expansion contraction deformation and regions not susceptible to deformation; causing the deformable sheet to undergo deformation under pressure to impart a pattern of unevennesses to the decorative material layer in contact with the sheet; and causing the decorative material layer to fully harden. The sheet deformed under pressure imparts a pattern of surface unevenness corresponding to the two kinds of regions to the decorative material layer. The degree of surface unevenness can be controlled by adjusting the pressure. Colored patterns corresponding to the unevennesses can also be formed.

U.S. Pat. No. 3,936,619 describes a method of forming an artificial stone comprising the steps of providing a flexible mold; pouring a curable mixture of polyester plastic and catalyst in the mold to form a polyester plastic body having a configured surface; scraping off excess of the curable mixture by applying sufficient pressure to depress the edges of the mold and form a raised lip on the plastic body; curing the mixture; removing the plastic body from the mold; spraying the configured surface with a liquid color layer and drying; spraying the color layer with a curable, transparent, liquid coat and curing said coat until the outer surface is gelled; spraying a thin layer of sand on the outer surface of said transparent coat, and curing the transparent coat, thereby bonding the sand layer to the transparent coat layer.

U.S. Pat. No. 4,349,588 teaches a method for producing simulated brick, tile wall or floor using cement, water-based adhesive and water insoluble powdered pigment. The mixture is applied and then partially set. Scoring indentations are made to remove cement. After being completely set, mortar is placed in the indentations as a grout and allowed to set The final step is a clear water-resistant coating on the entire surface.

U.S. Pat. No. 4,126,727 shows a resinous polymer sheet material having selective, decorative effects comprising a first layer of a resinous polymer composition; a pattern or design printed on and adhered to the surface of the first layer of resinous polymer composition and having relatively dark colored printed portions and relatively light colored printed portions. A second layer of a resinous polymer composition is applied on and adhered to the printed pattern or design and to the first layer of resinous polymer composition. The second layer of resinous polymer composition includes a layer of relatively small flat, decorative chips or flakes comprising a very thin layer of translucent or transparent platelets provided with coating. Light wave interference and color absorptive effects are created as light waves strike and reflect from the second layer of resinous polymer composition whereby the decorative chips or flakes located over the relatively dark colored printed portions are discernible from eye-level or a distance of about five feet whereas those decorative chips or flakes located over the relatively light colored printed portions are indiscernible from eye-level or a distance of about five feet.

U.S. Pat. No. 4,105,816 describes a decorative relief finished surface formed to a substrate by applying an undercoat to a predetermined thickness and forming an uneven pattern with a rolling device having a plurality of convex parts of curved continued, disconnected or perforated line shape which are formed in a random manner, with the intervals between the convex parts being substantially equal to each other, or by spraying coating material with a spray gun so as to form a multiplicity of projections of varying height. Then, the top portions of the projections of the partially hardened surface which extend beyond a predetermined height are pressed with a pressing roll such that the projections are uniformly flattened to a predetermined thickness while the rest of the convex parts are left unflattened.

U.S. Pat. No. 3,882,218 shows embossed decorative patterns and decorative laminates, particularly textured film finished structural elements and the method of manufacture wherein a resilient material such as a wadding sheet or pad sheet is interposed between the surface film and the substrate.

U.S. Pat. No. 3,152,002 describes a process of making elastomeric flooring of variegated color comprising the steps of coating a sheet of backing material with a liquid polyvinyl chloride plastisol delivering a charge of solid unheated plastic granules of polyvinyl chloride compound and different colors to the coated backing sheet, spreading the granules in a layer of substantially uniform thickness in the liquid plastisol, partially curing the plastisol to fix the position of the granules on the backing sheet and then molding the components into a product of the desired surface texture.

U.S. Pat. No. 3,012,295 teaches a process of producing an elastomeric covering for floors, walls and the like comprising the steps of mixing a plurality of moldable vinyl elastomers of different shades of the same base color, calendering the mixture to form a solid mottled sheet of the selected colors, heating the calendered elastomeric sheet to molding temperature, molding the overall surface area of the sheet by applying a mold having a plurality of scattered low protuberances of irregular outline and of varying size, depth, configuration and distribution, removing the mold from the molded sheet, coating the molded surface of the elastomeric sheet with a paint of a color contrasting with the base color and then removing the colored paint immediately to expose plane surface areas of the molded elastomeric sheet while leaving the depressed areas of the cavities thereof permanently coated with the contrasting colored paint.

U.S. Pat. No. 2,577,241 shows a method of producing a face configuration of variable pattern which comprises impressing in the face of deformable material a textured surface element having a definite face pattern to thereby provide die deformable material with a face presenting a complete pattern complemental to the pattern of the element and then impressing on the deformable material face to a less depth a textured surface element in random relation to the complemental pattern to randomly modify the pattern of said material face while maintaining the general texture resulting from the first impression.

Moreover, walls have been constructed from individual stones, rocks, blocks or bricks assembled into a wall with mortar or the like. Such walls are expensive and time consuming to construct.

As a far less expensive alternative, walls may be constructed of hardenable construction material such as concrete. The outer face of such a wall may be smooth or textured having the appearance of a wall formed from a plurality of individual assembled units such as bricks or rocks.

U.S. Pat. No. 3,307,822 illustrates construction of a vertical wall from concrete to create the appearance of a wall of individual bricks. The technique of creating a vertical concrete wall with a contoured surface comprises pouring the wall between mold members having a contour on one or more of the lateral faces of the wall once the concrete hardens.

U.S. Pat. No. 5,232,646 describes a contoured wall and method for creating the contour and appearance of a wall formed from individual assembled units such as stones. The wall is formed form a plurality of interlocking wall portions that each have at least two non-linear mating surfaces. Each of the wall portions further has a lateral face contoured to resemble the stone wall. The wall is formed from hardenable construction such as concrete poured between two mold members. Each of the molds has a lateral mold face with at least one of the lateral faces having a plurality of interlocking contoured relief portions to provide a molded surface having the contour of a stone wall.

U.S. Pat. No. 5,225,134 shows a contoured wall and method for creating the contour and appearance of a wall formed from individual assembled units such as stones. The wall is formed from a plurality of mating form liners each having a reciprocal contoured surface to that of the desired stone wall. The wall is formed from hardenable construction such as concrete poured between two mold members with the form liners attached to at least one of the mold members. Each of the form liners has a lateral relief mold face adapted to provide a molded surface having the contour of a stone wall. Each lateral relief mold face of the form liners has a lattice work non-linear mortar-forming interlocking portion surrounding stone-forming recessed portions. The form liners are positionable in a plurality of arrangements wherein the interlocking portions and recessed portions along the mating edge of each form liner mate along the mating edge of the adjacent form liner to form a continuous lateral relief mold face.

U.S. Pat. No. 4,769,191 teaches a reinforced concrete wall such as a road barrier or barricade having a monolithic surface ornamentation constituted by pigmented cements and grooves simulating mortar joints. In the horizontally oriented top portions of the wall where the pigmented cements are substantially thicker than the layers of pigmented cements monolithically jointed to the vertical oriented portions of the wall so that these portions, which are subject to chipping and the like during handling and use will retain their aesthetically pleasing appearance. In the molding process, ribs on the mold surface which will form the grooves have a retardant applied thereto so that the cement forming the mortar joint will set at a slower rate than the rest of the body of the concrete wall and when removed from the mold can be brushed. When the wall is in the form of a road barrier, the ends are provided with a conical projection and a conical recess, respectively, to provide coupling between adjacent wall units.

U.S. Pat. No. 5,167,991 describes a method for producing a replicated stone surface comprising the steps of preparing a polymer mortar, coating a substrate with the polymer mortar, leveling the polymer mortar to a substantially even thickness, creating a textured surface on the polymer mortar, applying a hydrophobic release agent to the surface of polymer mortar, displacing portions of the polymer by pressing a patterned tool on the surface of the polymer mortar to form the plurality of simulated stones with raised peripheral edges and intervening simulated grout lines, allowing the polymer mortar to cure, applying a pigment to the surface of the plurality of simulated stones and simulated intervening grout lines, buffing the surface of the plurality of simulated stones and simulated intervening grout lines to impregnate the pores thereof with the pigment, abrading the surface of the plurality of simulated stones to create a weathered appearance and sealing the surface of the plurality of simulated stones and simulated intervening grout lines with a sealer to protect the replicated stone surface.

U.S. Pat. No. 4,043,826 shows a lightweight a rock made by molding a composition comprising cement, a lightweight filler, water, a curing agent for the cement and an acrylic resin latex in a flexible mold and thereafter nonuniformly coloring the hardened rock body so formed with cement dyes and/or pigments.

U.S. Pat. No. 3,621,086 teaches a process for making concrete brick which has a sufficiently smooth and attractively colored surface to be used as a facing or outside surface building unit. Colors are applied as fluid color mixes to a plurality of the vertical faces of the mold chambers in a block making machine prior to adding concrete mix thereto. Rapidly thereafter, concrete mix is added and the mold is vibrated to compact the mix and concurrently distribute over the surface of the material in the mold portions of the color mix to achieve a desired color effect. The color mix applied to the mold surface may be changed according to a predetermined pattern on each batch of such bricks.

U.S. Pat. No. 3,939,238 describes a process for coating concrete bricks with exposed surfaces having sharply delineated portions of contrasting color and/or texture by periodically and regularly forming atomized particles of a viscous cementitious slurry and directing same on to portions or surfaces of each of a plurality of green concrete bricks in groups located stationary in regular fashion for a brief period and thereafter firing the thus coated uncured brick. The processes include steps for rapidly and/or sequentially varying the colors applied to the different groups of bricks during successive cycles of coating the successively treated different groups of such bricks.

DE 3,601,041 shows an artificial stone molding technique using rubber shell mold, in a box filled with rigid foam and fairly dry cement mix, with high mineral content.

WO 86103433 teaches simulated stone or wood covering for floors or walls made by successive application of vinyl acetate emulsion, sand and cement containing modified acrylic resin.

DE 3,813,851 describes a method of producing concrete panel with decorative surface by first placing layer of colored particles in panel mold.

U.S. Pat. No. 1,681,727 shows a process of casting artificial stone to produce a revealed, textured surface which consists in preparing a sand mold, toughening a surface thereof corresponding to a revealed face of the piece to be cast by applying thereto irregularly arranged granular particles to produce a mold surface presenting irregularly arranged elevations, fluid treating the mold surface by spattering or spraying thereon masses of paraffin commingled with an oily fluid, and introducing into the mold a wet, stone-producing compound containing hydraulic cement U.S. Pat. No. 2,047,426 teaches a composition for coloring porous cementitious comprising a dye dissolved in alcohol and mixed with an aromatic hydrocarbon and bituminous dispersing material.

U.S. Pat. No. 2,819,495 describes a method of forming an L-shaped building block having on its outer sides a simulation of a plurality of masonry elements held together by mortar comprising forming a molding block having a pair of legs disposed in perpendicular relation, each leg being provided with a surface corresponding to that of the masonry elements to be simulated and extending ridges corresponding to the masonry elements to be simulated on the horizontal leg and up to the level of the ridges; placing additional mortar on the mortar first applied and on the ridges of the horizontal leg, the additional motor having a color corresponding to that of the groove motor normally showing in the grooves between such masonry elements; placing a cover block with one leg elevated and the other leg horizontal; placing mortar of a color corresponding to the masonry elements to be simulated on the other leg and up to the level of the ridges; placing additional mortar on the mortar last applied and on the ridges of the other leg, the additional mortar having a color corresponding to that of the groove mortar normally showing in the grooves between such masonry elements; removing the cover, placing a zig-zag plate, having a configuration corresponding to the ends and die surfaces of the mortar opposite the legs, against the mortar; supporting the mortar by the plate, removing the molding block, and, curing the mortar while supported by the zig-zag plate.

U.S. Pat. No. 3,426,122 shows a process for molding cement products which are used to make retaining walls. The molded product is made within a mold cavity having a resilient mold piece at the bottom of the mold cavity and which is held at the opposite ends thereof only, so that the mold piece will flex upwardly thereby providing gradual release between the mold piece and the molded article. The molded piece can be removed while still green and without producing breakage of the article during such removal.

Additional examples of the prior art are found in U.S. Pat. No. 2,955,324; U.S. Pat. No. 3,759,481; U.S. Pat. No 3,839,514; U.S. Pat. No. 3,848,043; U.S. Pat. No. 5,002,817; U.S. Pat. No. 5,431,366; U.S. Pat. No. 5,536,557; and U.S. Pat. No. 5,667,190.

SUMMARY OF THE INVENTION

The present invention relates to a form liner for producing a wall or other structure of cementitious material with a surface having the appearance of natural stone or rock and grout lines without the form liner seams observed in the prior art.

In particular, when separate surface areas are produced to form a wall using the prior art, visible seams are formed between adjacent edges of adjacent surface areas. So produced, the random appearance of the plurality of stone or rock elements and the simulated grout lines is interrupted by the seams or lines formed between adjacent surface areas detracting from the over all natural appearance of the wall.

In contrast, the form liners of the present invention produce a wall of cememtitious material including a plurality of protrusions extending outwardly therefrom. The protrusions extending outwardly create a relief of irregularly shaped elements having the appearance of individual stones or rocks and simulated grout lines formed therebetween.

Each surface area has an irregular configuration or shape comprising a pair of irregular side edges formed on opposite ends thereof and irregular upper and lower edges formed on the top and bottom portions respectively thereof.

When the separate areas are produced to form the wall using the present invention, corresponding edges of adjacent surface areas are obverse and interfaced to produce a visually imperceptible irregular mating line. So produced, the simulated grout lines between the plurality of stone or rock elements and the irregular mating line formed between adjacent surface areas do not detract from the overall natural appearance of the wall.

The form liner of the present invention comprises an obverse mold and a plurality of obverse keystone liner plugs used to form the wall as described more fully hereinafter. Each obverse mold comprises an outer irregular peripheral edge including a plurality of projections and interrupted by a plurality of plug recesses formed therein and a plurality of relief forming pockets formed therein corresponding to the individual stone or rock elements and raised grout line forming edge extending outwardly therefrom corresponding to the simulated circuitous grout line. Each relief forming pocket comprises an irregular bottom surface having an irregular edge formed about the periphery thereof. Each obverse keystone liner plug comprises an outer irregular peripheral edge shaped and configured to be positioned within the peripheral plug recesses or the cavity cooperatively formed by corresponding interior plug recesses when the corresponding portions of the outer irregular peripheral edge of adjacent obverse molds are aligned to engage each other along the mated surfaces and a relief forming pocket having an irregular bottom surface to form an individual stone or rock element.

In use, a plurality of form liners are operatively assembled in a form such as disclosed and described in U.S. Pat. No. 5,637,236.

The wall is produced by mating the form liners relative to each other to receive the cementitious material; positioning the obverse relief keystone liner plugs; preparing the cementitious material; pouring the cementitious material into the form; vibrating the cementitious material; allowing the cementitious material to cure to form the wall of cementitious material having the appearance of natural stone and mortar including the base with the outer surface with the plurality of irregular shaped protrusions disposed in a random pattern to simulate natural stones and the plurality of simulated grout liness formed therebetween; separating the form from the cured cementitious material and sealing the surface having the appearance of natural stone or rock with a sealer.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a form liner for use in a system such as that disclosed and described in U.S. Pat. No. 5,637,236 to produce a wall or other structure of cementitious material with a surface having the appearance of natural stone or rock and grout line without the form liner seams observed in the prior art.

Figure 1:
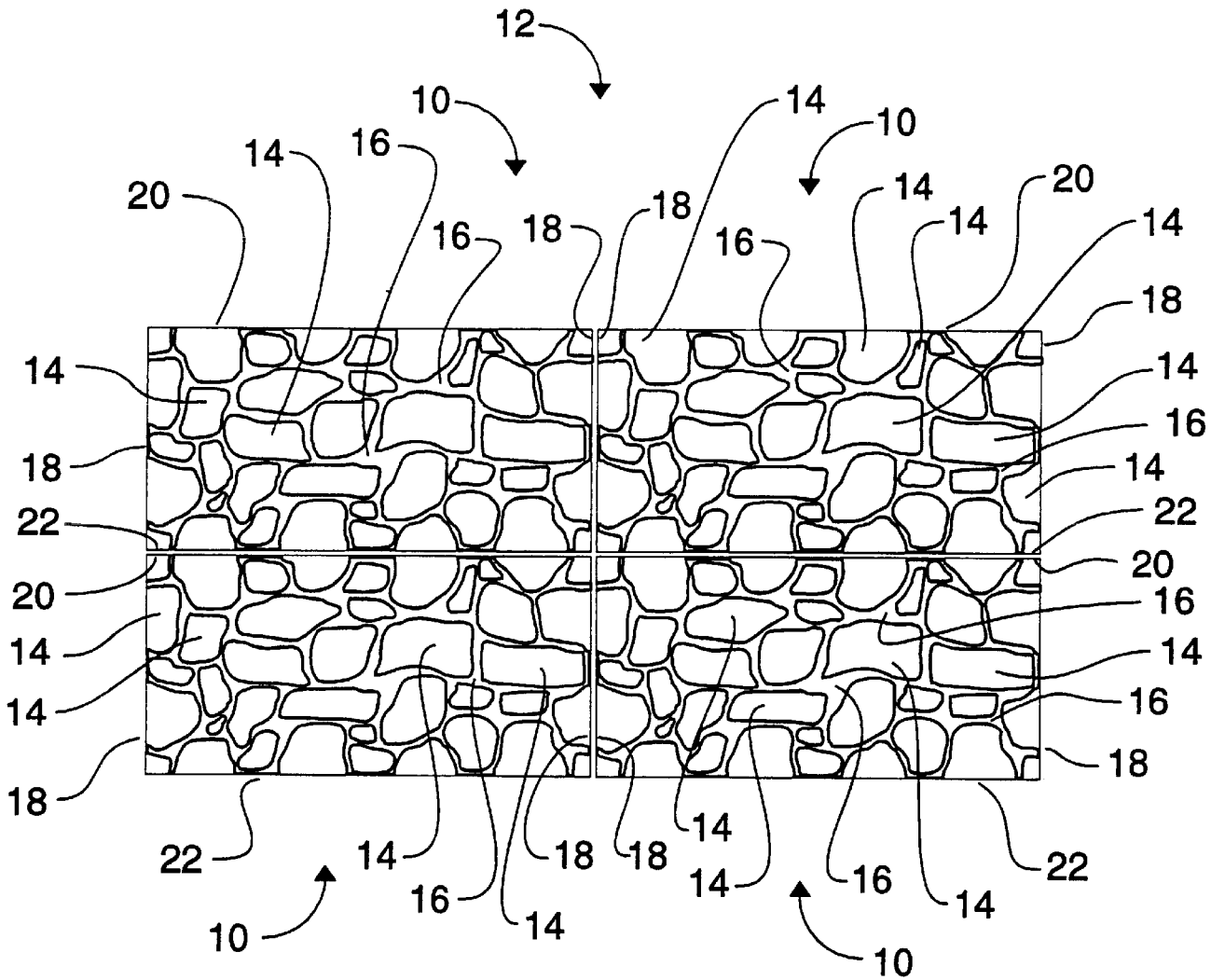
FIG. 1 is a front view of a wall constructed using a plurality of form liners of the prior art.

FIG. 1 shows separate surface areas each generally indicated as 10 each formed by a form liner combined to produce a wall generally indicated as 12 of cementitious material having an outer surface including a plurality of protrusions extending outwardly therefrom produced using conventional form liners found in the prior art. The protrusions extending outwardly to form the outer surface of the wall 12 to create a relief of irregularly shaped elements having the appearance of stones or rocks each indicated as 14 with simulated grout lines 16 formed therebetween. The outer surface is typically shaded and sealed to protect the outer surface from the environment.

Each surface area 10 has a substantially rectilinear configuration or shape comprising a pair of substantially straight side edges each indicated as 18 formed on opposite end portions thereof and substantially straight upper and lower edges indicated as 20 and 22 respectively formed on the top and bottom portions respectively thereof.

Figure 2:
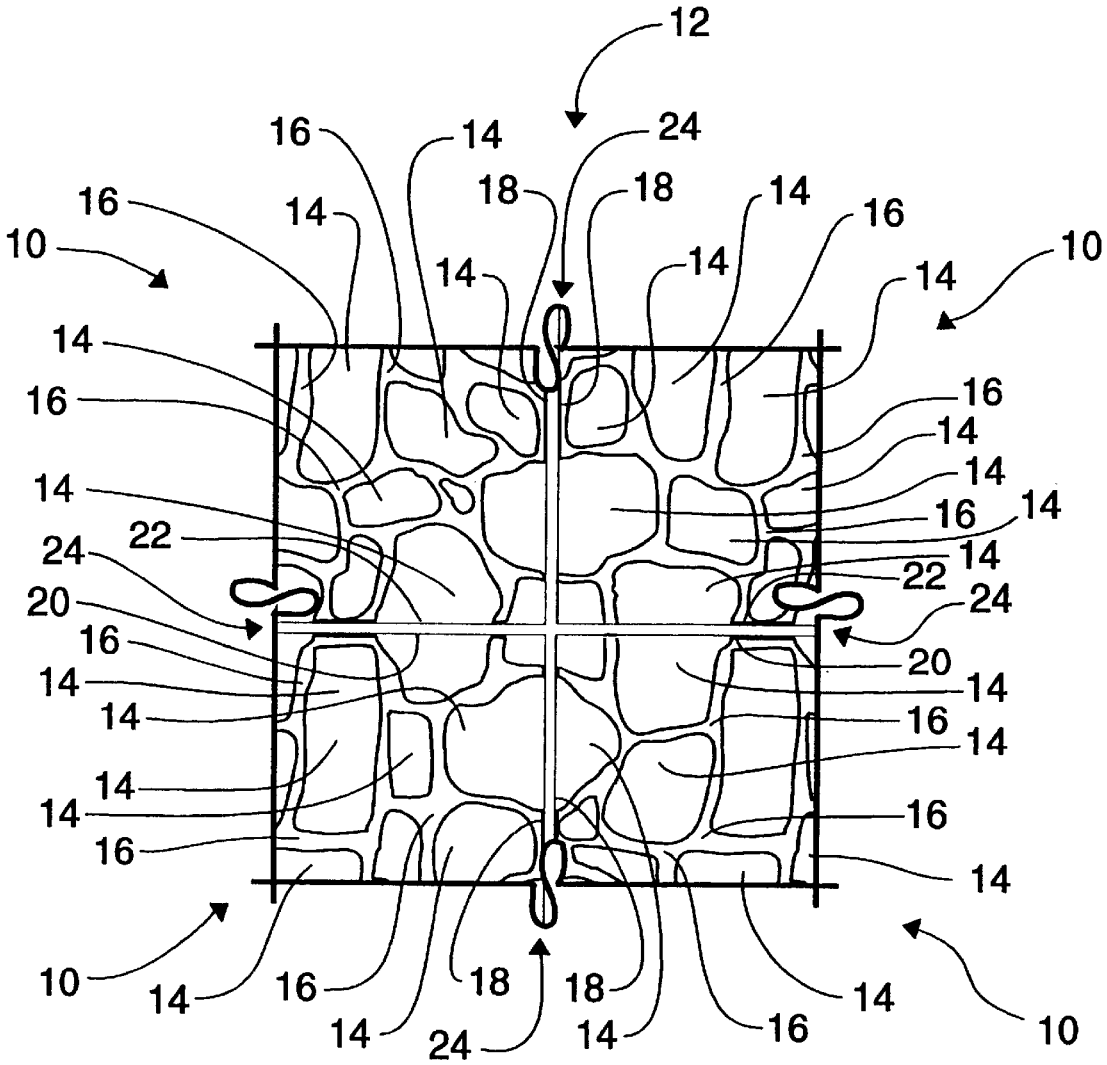
FIG. 2 is a detailed partial front view of the wall of FIG. 1 constructed using a plurality of form liners of the prior art.

As shown in FIGS. 1 and 2, when the separate surface areas are produced to form the outer surface of the wall 12 using the prior art form liners, seams or lines 24 are formed between adjacent edges 18 and 18, and adjacent edges 20 and 22 of adjacent surface areas 10. So produced, the random appearance of the plurality of stone or rock elements 14 and the simulated grout line 16 is interrupted or broken by the seams or lines 24 formed between adjacent surface areas 10 detracting from the overall natural appearance of the wall 12.

Figure 3:
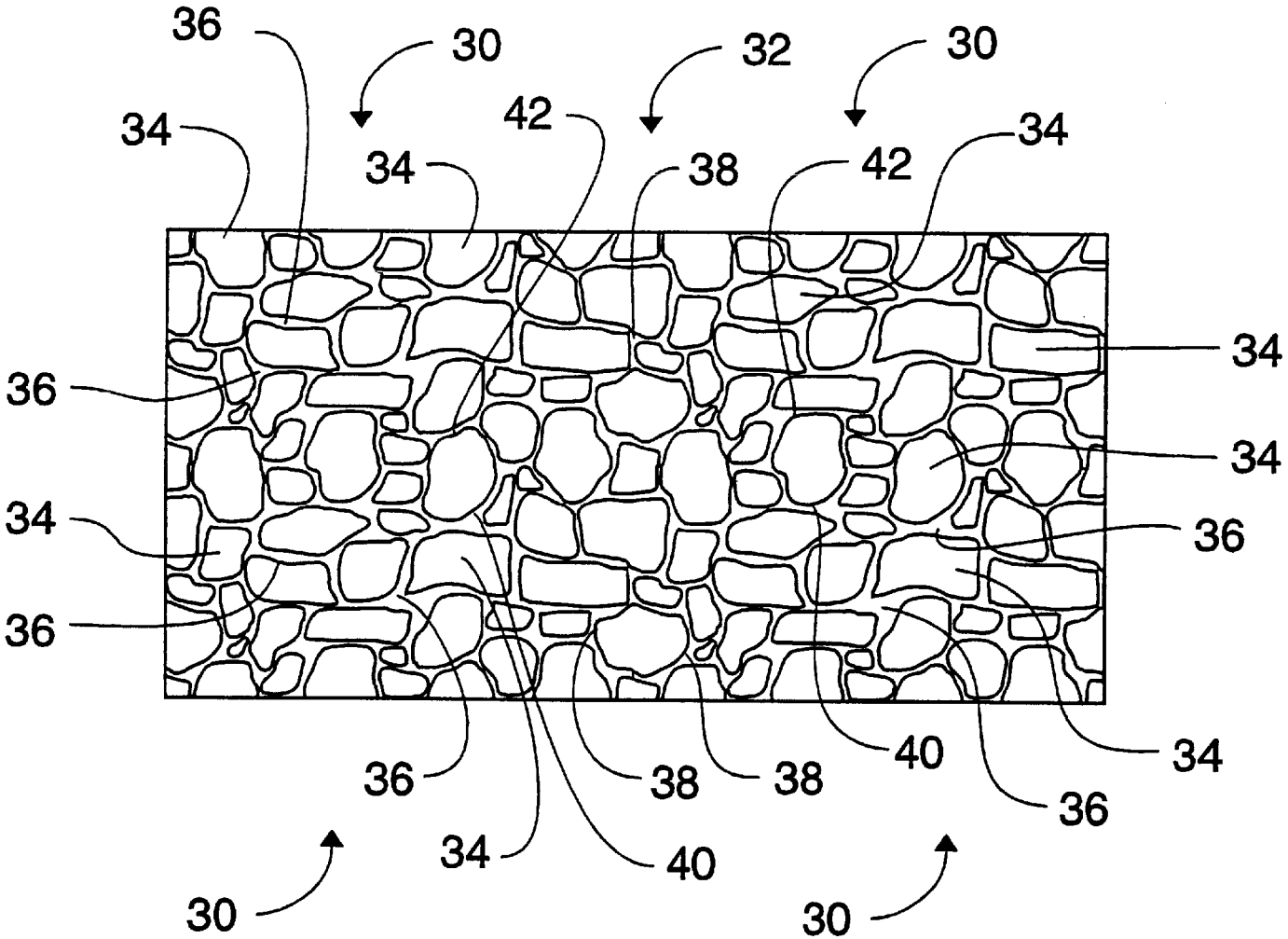
FIG. 3 is a front view of a wall constructed using a plurality of form liners of the present invention.

In contrast, FIG. 3 shows separate surface areas each generally indicated as 30 each formed by a form liner combined to produce a wall generally indicated as 32 of cementitious material having an outer surface including a plurality of protrusions extending outwardly therefrom produced using a plurality of the form liners of the present invention as described more fully hereinafter. The protrusions extend outwardly to form the outer surface of the wall 30 to create a relief of irregularly shaped elements having the appearance of individual stones or rocks each indicated as 34 and simulated grout lines 36 formed therebetween. The outer surface is typically shaded and sealed to enhance the natural stone or rock appearance and to protect the outer surface from the environment.

Each surface area 30 has an irregular configuration or shape comprising a pair of irregular side edges each indicated as 38 formed on opposite ends thereof and irregular upper and lower edges indicated as 40 and 42 respectively formed on the top and bottom portions respectively thereof.

Figure 4:
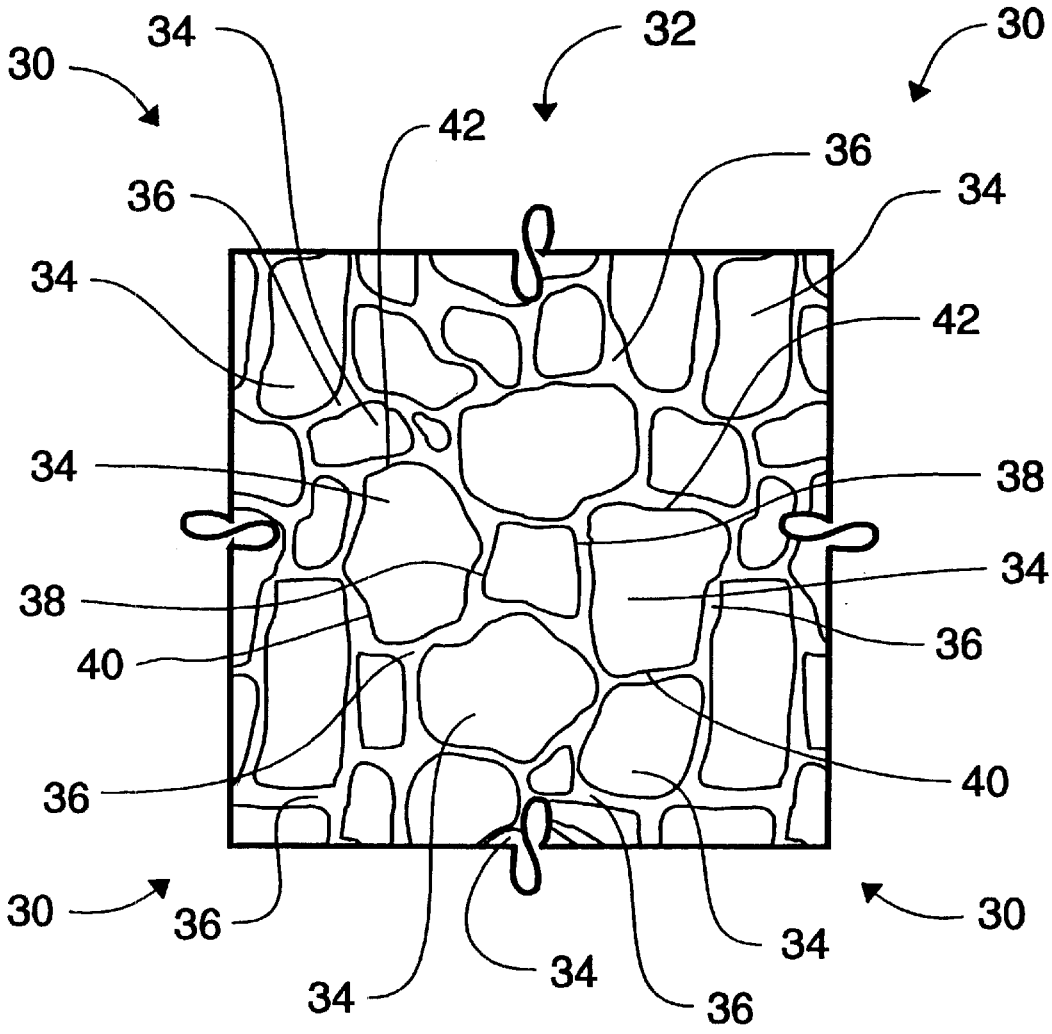
FIG. 4 is a detailed partial front view of the wall of FIG. 3 constructed using a plurality of form liners of the present invention.

As shown in FIGS. 3 and 4, when the separate areas 30 are produced to form the wall 32 using the form liners of the present invention, corresponding edges 38 and 38, 40 and 42, 40 and 38 or 38 and 42 of adjacent surface areas 30 are obverse and interfaced to produce an visually imperceptible irregular mating line 44. So produced, the simulated grout lines 36 between the plurality of stone or rock elements 34 and the irregular mating line 44 formed between adjacent surface areas 30 do not disrupt or detract from the overall natural appearance of the wall 32.

Figure 5:
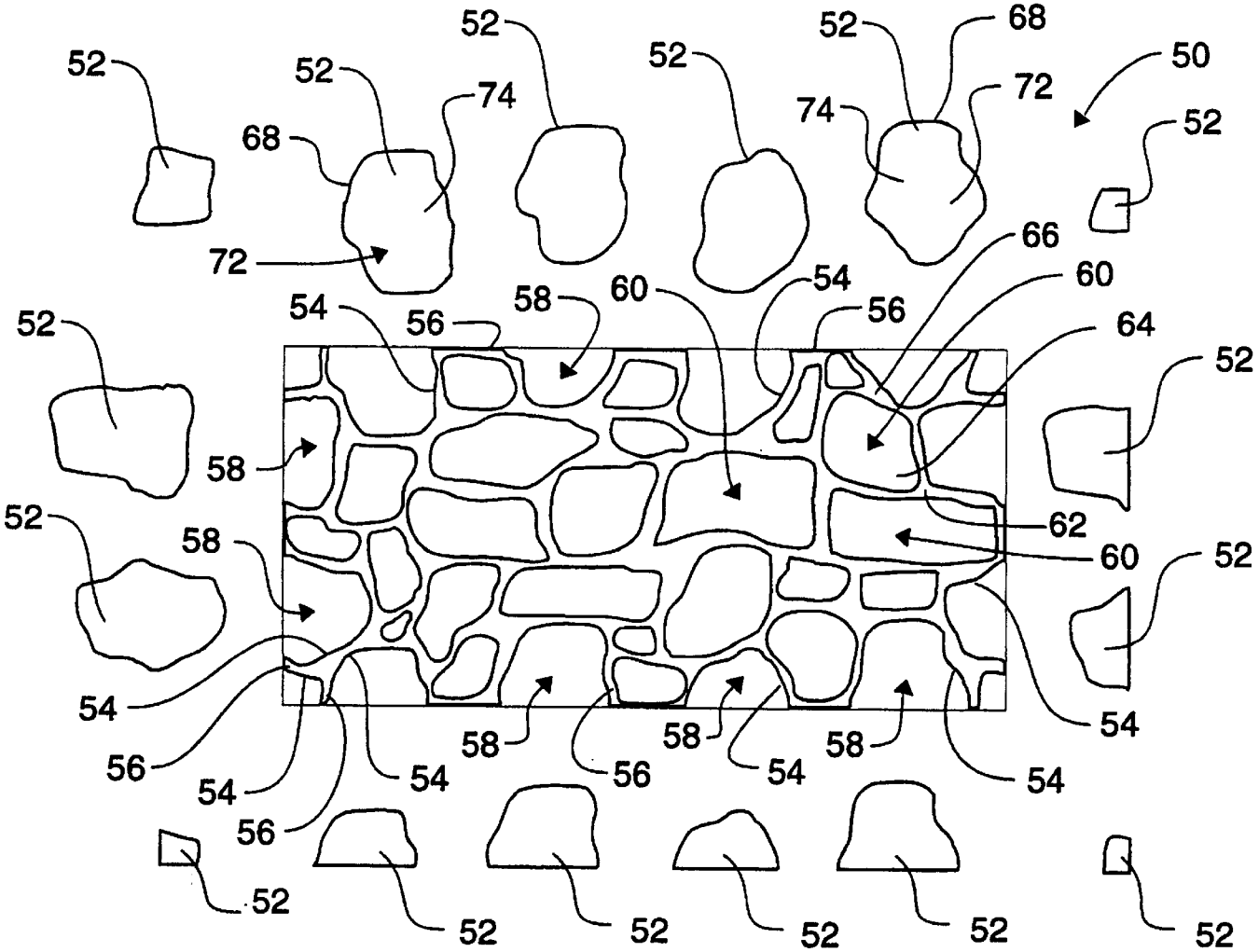
FIG. 5 is an exploded front view of a form liner of the present invention.
Figure 6:
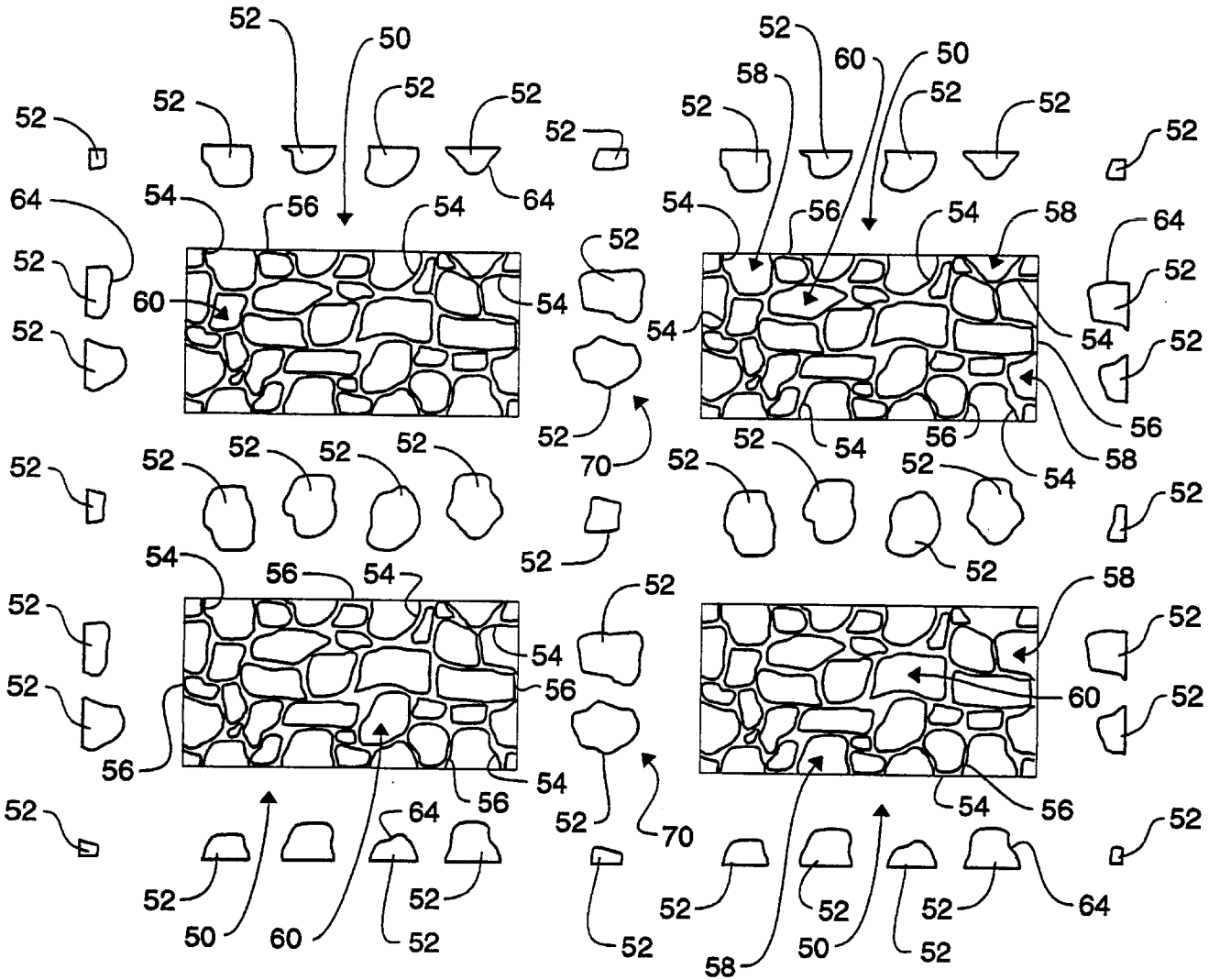
FIG. 6 is an exploded front view of a plurality of form liners of the present invention as depicted in FIG. 5.

FIGS. 5 and 6 show the form liner of the present invention comprising an obverse mold generally indicated as 50 and a plurality of obverse keystone liner plugs each indicated as 52 used to produce the wall 30 as described more fully hereinafter. Each obverse mold 50 comprises an outer irregular peripheral edge 54 including a plurality of peripheral projections having an irregular edge each indicated as 56 interrupted by a plurality of outer plug recesses having an irregular edge each indicated as 58 formed therein and a plurality of mold relief forming pockets each indicated as 60 formed therein corresponding to the individual stone or rock elements 34 and a raised grout line forming edge 62 extending outwardly therefrom corresponding to the simulated grout line 36. Each mold relief forming pocket 60 comprises an irregular bottom surface 64 having an irregular edge 66 formed about the periphery thereof.

Each obverse keystone liner plug 52 comprises an outer irregular peripheral edge 68 shaped and configured to be positioned within a corresponding outer peripheral plug recesses 58 or a corresponding interior plug cavity 70 cooperatively formed by corresponding plug recesses 58 when corresponding portions of the outer irregular peripheral edges of the peripheral projections 56 of adjacent obverse molds 50 engage each other along the mating edges and a keystone relief forming pocket 72 having an irregular bottom surface 74 corresponding to an individual stone or rock element 34 to be formed thereby.

The pockets 60 and 72 may include different indicia such as letters or numbers indicated as corresponding to the color or shade to be applied thereto.

Figure 7:
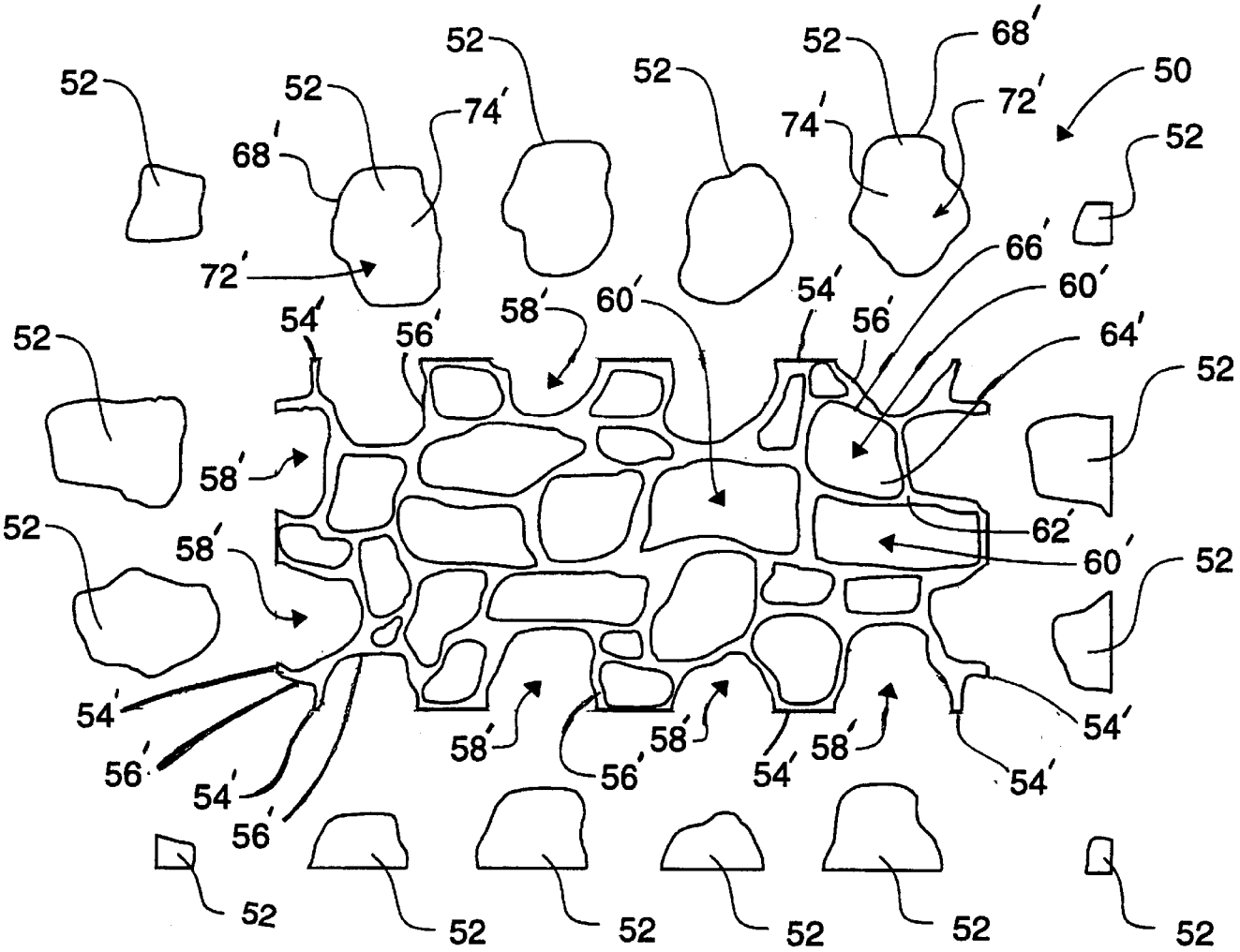
FIG. 7 is an exploded front view of an alternate embodiment of a form liner of the present invention.

FIG. 7 shows an alternate embodiment of the form liner of the present invention comprising an obverse mold generally indicated as 50 and a plurality of obverse keystone liner insert each indicated as 52 used to produce the wall 30 as described more fully hereinafter. Each obverse mold 50 comprises a plurality of irregularly shaped projections 54' interrupted or separated by a plurality of outer irregularly shaped plug openings or spaces each indicated as 58' formed therein to form an irregular edge or periphery 56' and a plurality of irregularly shaped mold relief forming pockets each indicated as 60' formed therein corresponding to the individual stone or rock elements 34 and a raised grout line forming edge 62' extending outwardly therefrom corresponding to the simulated grout line 36 shown in FIG. 3.

Each irregularly shaped mold relief forming pocket 60' comprises an irregularly shaped bottom surface 64' having an outer irregular edge 66' formed about the periphery thereof.

Each obverse keystone liner insert 52 comprises an outer irregular edge 68' formed about the periphery of a mold relief forming pocket 72' having an irregular bottom surface 74' shaped and configured to be positioned within a corresponding outer irregularly shaped plug opening or space 58'.

Figure 8:
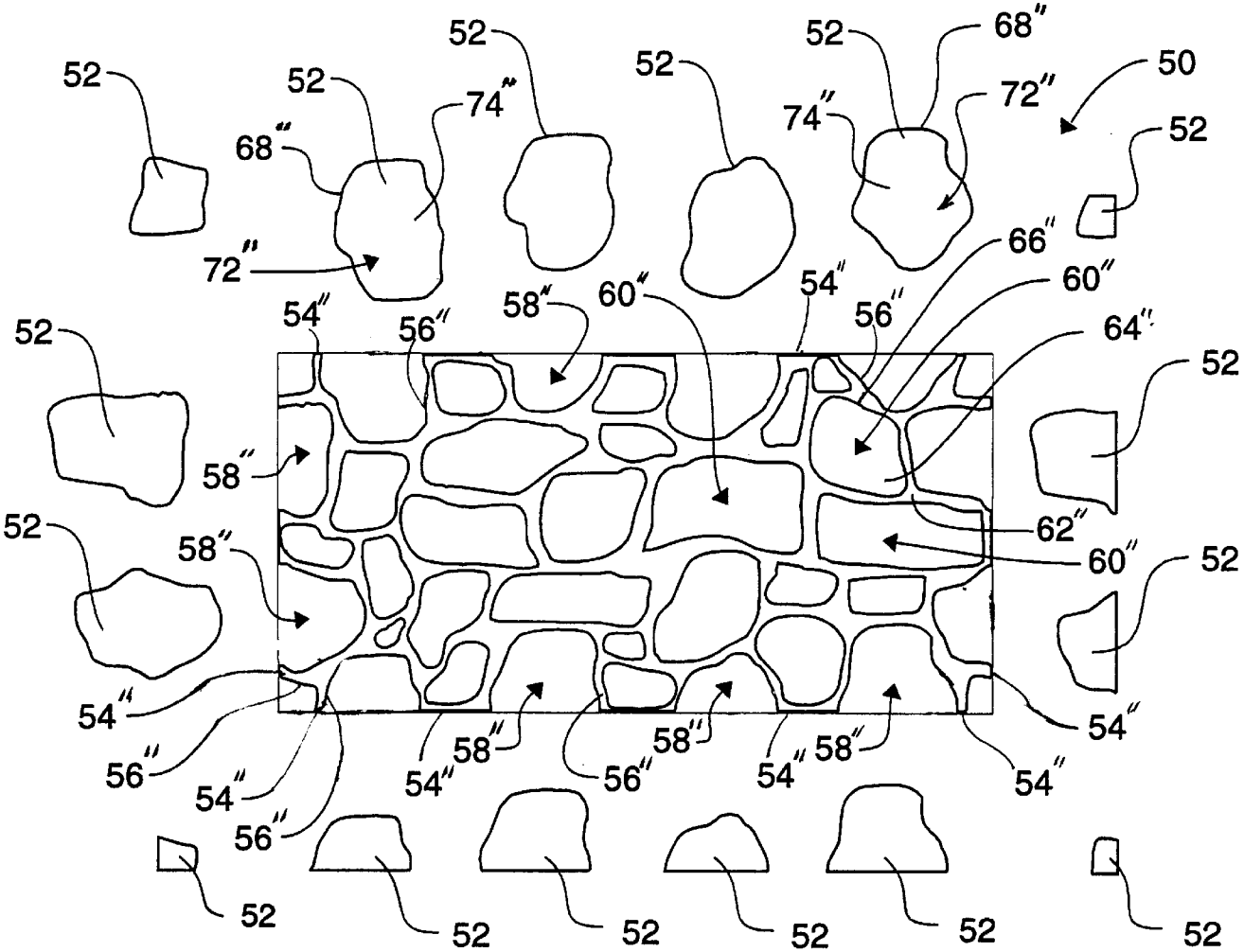
FIG. 8 is an exploded front view of another embodiment of a form liner of the present invention.

FIG. 8 shows another alternate embodiment the form liner of the present invention comprising an obverse mold generally indicated as 50 and a plurality of obverse keystone liner insert each indicated as 52 used to produce the wall 30 as described more fully hereinafter. Each obverse mold 50 comprises a raised grout line forming edge 62" extending upwardly from a substantially rectangular base or substrate to form an outer irregular periphery formed by a plurality of peripheral projections each indicated as 54" interrupted or separated by a plurality of outer plug recesses each indicated as 58" to form an irregular edge or periphery 56" and a plurality of irregularly shaped mold relief forming pockets each indicated as 60" formed therein corresponding to the individual stone or rock elements 34 and raised grout line forming edge 62" extending outwardly therefrom corresponding to the simulated grout line 36 shown in FIG. 3.

Each outer plug recess 58" comprises an irregular bottom surface; while, each irregularly shaped mold relief forming pocket 60" comprises an irregular bottom surface 64" having an outer irregular edge 66" formed about the periphery thereof.

Each obverse keystone liner insert 52 comprises an outer irregular peripheral edge 68" formed about the periphery of a mold relief forming pocket 72" having an irregular bottom surface 74" shaped and configured to be positioned within a corresponding outer plug recess 58".

In use, a plurality of form liners are operatively assembled in a form such as disclosed and described in U.S. Pat. No. 5,637,236. Such a form may include a pair of substantially vertically disposed outer form members forming a void or space therebetween to receive the cementitious material as described more fully hereinafter.

The wall 32 is produced by mating the form liners relative to each other to receive the cementitious material; positioning the obverse relief forming keystone liner plugs; preparing the cementitious material; pouring the cementitious material into the form; vibrating the cementitious material; allowing the cementitious material to cure to form the wall of cementitious material having the appearance of natural stone and mortar including the base with the outer surface with the plurality of irregular shaped protrusions disposed in a random pattern to simulate natural stones and the plurality of simulated grout lines formed therebetween; separating the form from the cured cementitious material and sealing the surface having the appearance of natural stone or rock with a sealer.

Figure 9:
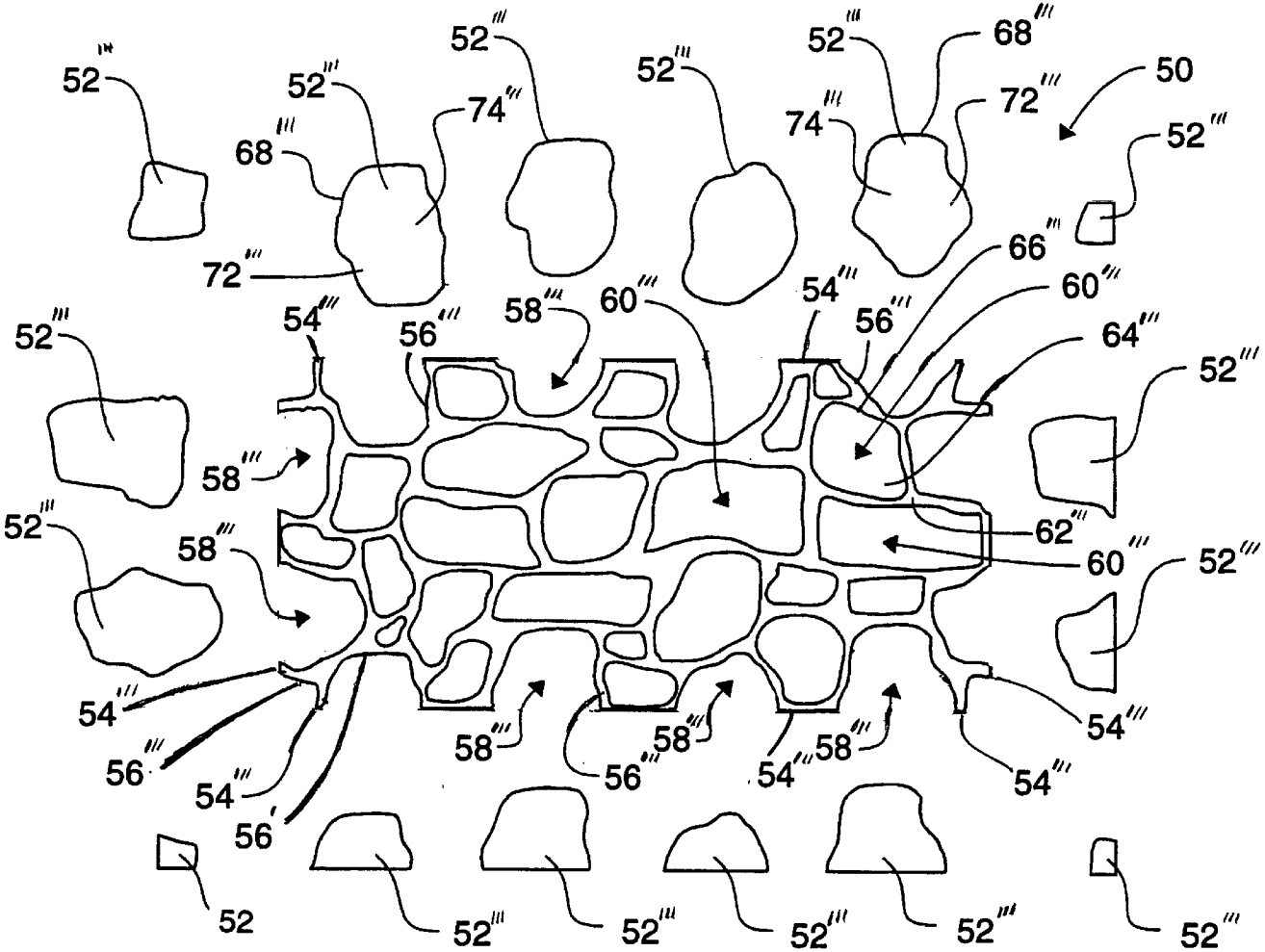
FIG. 9 is yet another exploded front view of another embodiment of a form liner of the present invention.

FIG. 9 shows yet another alternate embodiment of the form liner of the present invention comprising an obverse mold generally indicated as 50 for use with a plurality of individual stone or rock elements each indicated as 52'" used to produce the wall 30. Each obverse mold 50 comprises a plurality of irregularly shaped projections 54'" interrupted or separated by a plurality of outer irregularly shaped openings or spaces each indicated as 58'" formed therein to form an irregular edge or periphery 56'" and a plurality of irregularly shaped mold relief forming pockets each indicated as 60'" formed therein corresponding to the individual stone or rock elements 34 and a raised grout line forming edge 62' extending outwardly therefrom corresponding to the simulated grout line 36 shown in FIG. 3.

Each irregularly shaped mold relief forming pocket 60'" comprises an irregularly shaped bottom surface 64'" having an outer irregular edge 66' formed about the periphery thereof.

Each individual stone or rock element 52'" comprises an outer irregular edge 68'" formed about the periphery of a raised portion 72''' having an irregular surface 74''' shaped and configured to be positioned within a corresponding opening or aperture formed between adjacent obverse molds 50''' by a corresponding outer irregularly shaped openings or spaces 58''' when the wall 30 is formed.

This embodiment is used similarly to produce the wall 30 except that the corresponding outer irregularly shaped openings or spaces 58''' of adjacent forms 50 cooperatively form an opening in the wall 30 to receive the corresponding individual stone or rock element 52'''.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A system to produce a surface of cementitious material including a plurality of adjacent surface areas to simulate the appearance of natural stone or rock formed without seams visible between adjacent surface areas comprising at least two form liners and a plurality of keystone liner inserts wherein each said form liner comprises a mold including an obverse relief surface having an outer irregular peripheral edge including a plurality of peripheral projections having an irregular edge interrupted by a plurality of outer recesses having an irregular shape and a plurality of interior relief forming pockets wherein corresponding outer recesses of adjacent form liners are operatively aligned to engage adjacent edges therein to form a cavity having an irregular shape formed by said irregular shape of said corresponding outer recesses to selectively receive one of said keystone liner inserts having an irregular contoured pocket therein and including an outer irregular peripheral edge corresponding to said irregular shape of said corresponding cavity wherein said keystone liner inserts extend across adjacent form liners such that cementitious material poured into said plurality of interior relief forming pockets and said irregular contoured pockets form a simulated stone wall having an irregular seam formed between adjacent form liners to disguise the seam formed between adjacent surface areas as grout lines.

2. A system to produce a surface of cementitious material including a plurality of adjacent surface areas each produced by a form liner to simulate the appearance of natural stone or rock formed without seams visible between adjacent surface areas comprising at least two form liners and a plurality of keystone liner inserts wherein each said form liner comprises a mold including an obverse relief surface having an outer irregular peripheral edge including a plurality of peripheral projections having an irregular edge interrupted by a plurality of outer irregularly shaped openings and a plurality of interior relief forming pockets wherein corresponding outer irregularly shaped openings of adjacent form liners are operatively aligned relative to each other to cooperatively form a corresponding opening having an irregular shape formed by said irregular shape of said corresponding outer irregular shaped openings to receive one of said keystone liner inserts having an irregular contoured pocket therein and including an outer irregular peripheral edge corresponding to said irregular shape of said corresponding opening wherein said keystone liner inserts extend across adjacent form liners such that cementitious material poured into said plurality of interior relief forming pockets and said irregular contoured pockets form a simulated stone wall having an irregular seam formed between adjacent form liners to disguise the seam formed between adjacent surface areas as grout lines.

* * * * *